US007340791B2

(12) United States Patent
Jeong et al.

(10) Patent No.: US 7,340,791 B2
(45) Date of Patent: Mar. 11, 2008

(54) WASHING MACHINE AND METHOD OF CONTROLLING THE SAME

(75) Inventors: Ji Deok Jeong, Yongin-Si (KR); Doo Young Ryu, Suwon-Si (KR); Hyoung Hoon Roh, Suwon-Si (KR); Seung Moo Lim, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 635 days.

(21) Appl. No.: 10/902,812

(22) Filed: Aug. 2, 2004

(65) Prior Publication Data

US 2005/0102765 A1 May 19, 2005

(30) Foreign Application Priority Data

Nov. 18, 2003 (KR) ..... 10-2003-0081563

(51) Int. Cl.
*D06F 37/22* (2006.01)

(52) U.S. Cl. ..... 8/158; 68/12.06; 68/23.1

(58) Field of Classification Search ..... 8/158–159; 68/12.02, 12.06, 23.1
See application file for complete search history.

(56) References Cited

U.S. PATENT DOCUMENTS 5,452,594 A * 9/1995 Kim et al. ..... 68/3 SS
5,834,650 A * 11/1998 Kim ..... 73/651
5,946,947 A 9/1999 Lee et al.
6,470,751 B1 * 10/2002 Baek ..... 73/652
2002/0100329 A1 * 8/2002 Baek ..... 73/649
2003/0015039 A1 * 1/2003 Baek ..... 73/661
2006/0164093 A1 * 7/2006 Ooe et al. ..... 324/432

FOREIGN PATENT DOCUMENTS

JP 03264088 A * 11/1991
JP 07204383 A * 8/1995

OTHER PUBLICATIONS

Electronic translation of JP 07204383.*

* cited by examiner

*Primary Examiner*—Joseph L. Perrin
(74) *Attorney, Agent, or Firm*—Staas & Halsey LLP

(57) ABSTRACT

A washing machine and a control method thereof are provided, which control a rotational speed of a rotary tub (or revolutions per minute: RPM of a motor) according to a vibration level thereof to attenuate a vibration of the rotary tub. The washing machine includes the rotary tub, the motor, a vibration detecting unit and a control unit. The motor is linked to the rotary tub to be supplied with drive power and rotates the rotary tub. The vibration detecting unit detects the vibration level of the rotary tub using a variation of the drive power supplied to the motor when the motorrotates. The control unit controls a current rotational speed of the motor to be increased, maintained or decreased according to the vibration level of the rotary tub detected by the vibration detecting unit.

23 Claims, 4 Drawing Sheets

WASHING MACHINE AND METHOD OF CONTROLLING THE SAME

CROSS-REFERENCE TO RELATED APPLICATION

This application claims the benefit of Korean Patent Application No. 2003-81563, filed Nov. 18, 2003 in the Korean Intellectual Property Office, the disclosure of which is incorporated herein by reference.

BACKGROUND OF THE INVENTION

1. Field of the Invention

The present invention relates, in general, to washing machines and, more particularly, to a washing machine, which performs spin-drying of laundry by a rotating operation of a rotary tub.

2. Description of the Related Art

Generally, washing machines are classified into front loading washing machines and top loading washing machines. In a front loading washing machine (i.e., a drum washing machine), a rotary tub rotates around a horizontal axis, and laundry is placed into or taken out from the rotary tub through a door placed on a front of the front loading washing machine. In a top loading washing machine (i.e., a vertical washing machine), a rotary tub rotates around a vertical axis and laundry is placed into or taken out from the rotary tub through a door placed on a top of the top loading washing machine.

The rotary tub provided in the front or top loading washing machine allows washing, rinsing and spin-drying processes to be executed by rotating the laundry. In the spin-drying process of the front or top loading washing machine, the rotary tub rotates at a high speed, thus generating a centrifugal force within the rotary tub. Due to the centrifugal force, water absorbed by the laundry is removed by the centrifugal force from the laundry.

The rotary tub must be rotated to perform spin-drying. However, if the rotary tub rotates while the washing machine is to be inclined or while maldistribution of the laundry occurs in the rotary tub, vibrations of the rotary tub occur. As a rotational speed of the rotary tub rises, the vibrations also increase.

SUMMARY OF THE INVENTION

Accordingly, it is an aspect of the present invention to provide a washing machine and method of controlling the washing machine, which suitably controls a rotational speed of a rotary tub (or revolutions per minute (RPM) of a motor) according to a vibration level of the rotary tub during rotation of the rotary tub, thus resulting in an attenuation of the vibration.

Additional aspects and/or advantages of the invention will be set forth in part in the description which follows and, in part, will be obvious from the description, or may be learned by practice of the invention.

The above and/or other aspects are achieved by providing a washing machine, including a rotary tub, a motor, a vibration detecting unit and a control unit. The motor is mechanically connected to the rotary tub to be supplied with drive power and then rotated to rotate the rotary tub. The vibration detecting unit detects a vibration level of the rotary tub during a rotation of the rotary tub using a variation of the drive power supplied to the motor when the motorrotates. The control unit controls a current rotational speed of the motor to be increased, maintained or decreased according to the vibration level of the rotary tub detected by the vibration detecting unit, thus resulting in an attenuation of the vibration level of the rotary tub.

The above and/or other aspects are achieved by providing a method of controlling a washing machine. In the washing machine control method, a vibration level of the rotary tub during a rotation of the rotary tub is detected using a variation of drive power supplied to the motor when the motor rotates. A current rotational speed of the motor is controlled to be increased, maintained or decreased according to the detected vibration level of the rotary tub, thus resulting in an attenuation of the vibration of the rotary tub.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
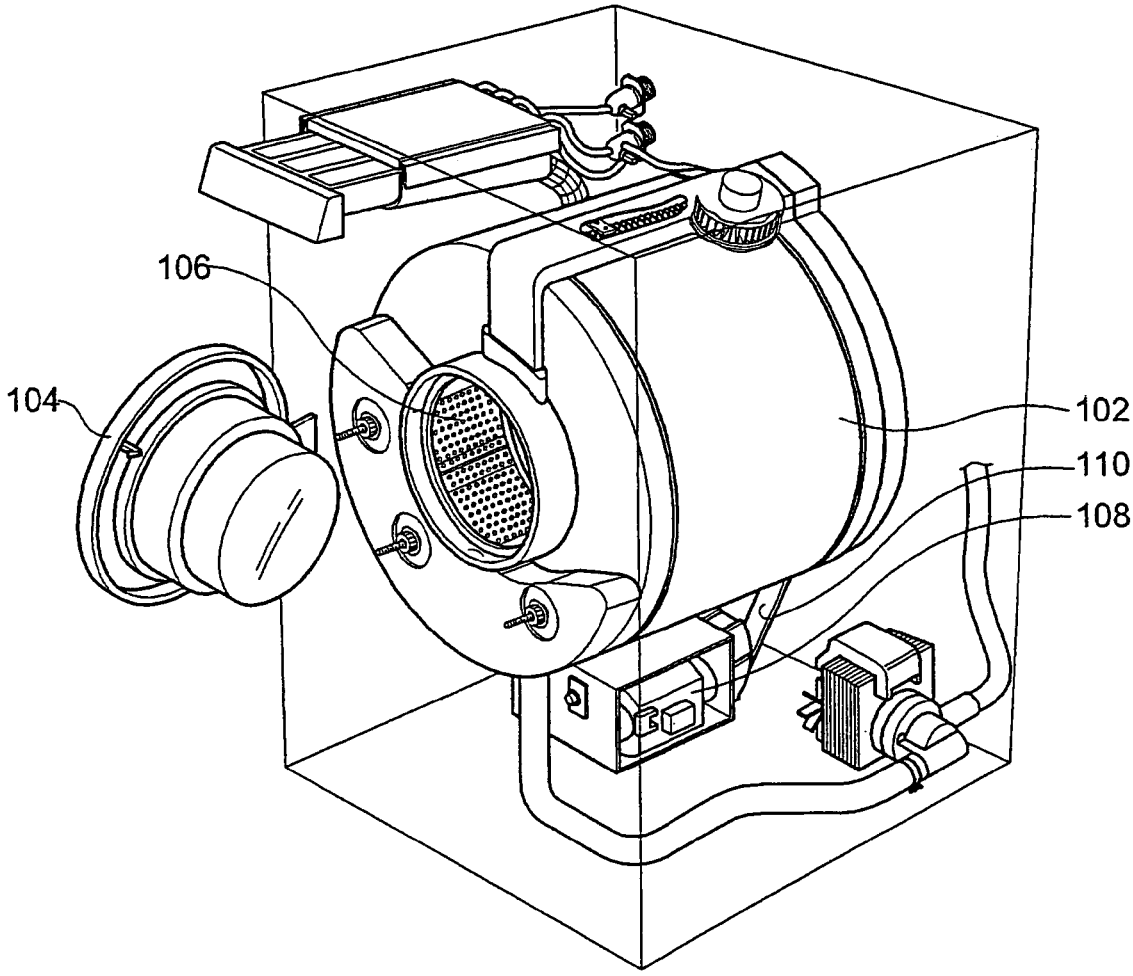
FIG. 1 is a view showing a washing machine, according to an embodiment of the present invention.

Reference will now be made in detail to the embodiment of the present invention, examples of which are illustrated in the accompanying drawings, wherein like reference numerals refer to the like elements throughout. The embodiment is described below to explain the present invention by referring to the figures.

FIG. 1 is a view showing a washing machine, according to a first embodiment of the present invention, in which a front loading washing machine (i.e., a drum washing machine) is depicted. As shown in FIG. 1, a door 104 is provided on a front of a fixed tub 102, and a rotary tub 106 is rotatably provided within the fixed tub 102. The fixed tub 102 is used to contain wash water therein, and the rotary tub 106 disposed within the fixed tub 102 is used to rotate laundry. The rotary tub 106 rotates by the drive of a motor 108, and rotary power of the motor 108 transmitted to the rotary tub 106 through a belt 110.

Figure 2:
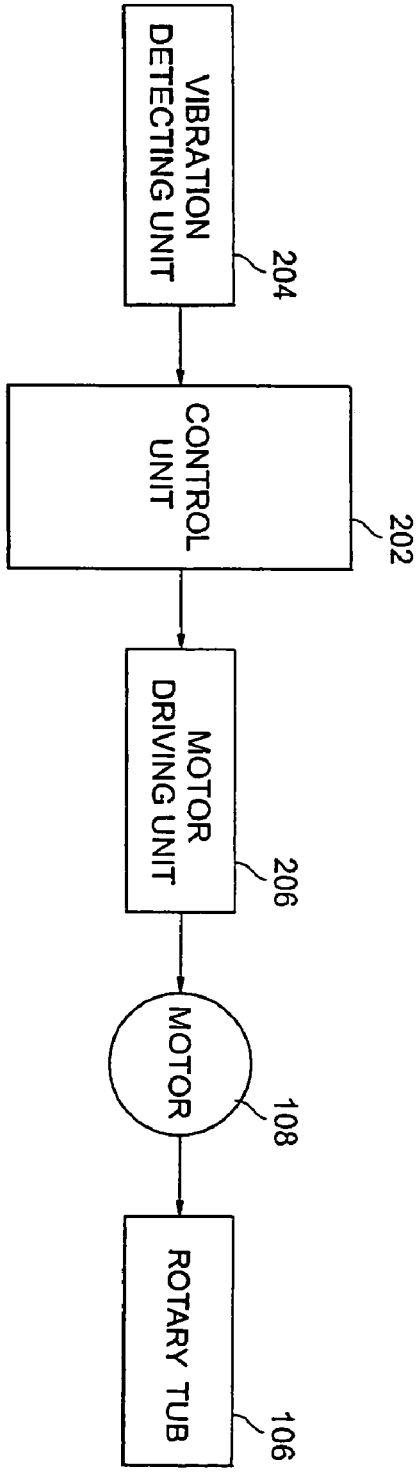
FIG. 2 is a block diagram showing a control system of the washing machine of FIG. 1.

FIG. 2 is a block diagram showing a control system of the washing machine of FIG. 1, in which the control system detects a vibration occurring when the rotary tub 106 rotates, and controls a rotational speed of the rotary tub 106 (or RPM of the motor 108) according to a vibration level of the rotary tub 106. As shown in FIG. 2, a vibration detecting unit 204 is connected to an input terminal of a control unit 202, which controls an entire operation of the washing machine. The vibration detecting unit 204 detects values of a voltage and phase of drive power supplied to the motor 108. The control unit 202 detects variations of the voltage and the phase of the drive power supplied to the motor 108 through the vibration detecting unit 204 and determines the vibration level of the rotary tub 106 based on the detected values. An output terminal of the control unit 202 is connected to a motor driving unit 206, which drives the motor 108 to rotate the rotary tub 106. If the control unit 202 issues a target rotational speed command to the motor driving unit 206, the motor driving unit 206 controls the voltage and the phase of the drive power supplied to the motor 108 to allow a current rotational speed of the motor 108 to follow a target rotational speed of the motor 108.

Because the drive power supplied to the motor 108 is controlled to allow the current rotational speed of the motor 108 to follow the target rotational speed of the motor 108, the motor driving unit 206 supplies more drive power to the motor 108. The supply of more drive power to the motor 108 allows the current rotational speed of the motor 108 to reach the target rotational speed, but not all of the rotary power of the motor 108 is used on the rotation of the rotary tub 106, as some portion of the rotary power of the motor 108 is used on the vibration of the rotary tub 106. Thus, as the vibration level increases when the rotary tub 106 rotates, an intensity of the supplied drive power also increases in proportion to the vibration level. The control unit 202 determines the vibration level of the rotary tub 106 through the variations of the supplied drive power. As the rotational speed of the rotary tub 106 according to the rotational speed of the motor 108 increases, the vibration level also increases. Therefore, when the vibration level of the rotary tub 106 excessively increases, the rotational speed thereof should not increase and, if necessary, the rotational speed thereof should occasionally decrease.

Figure 3:
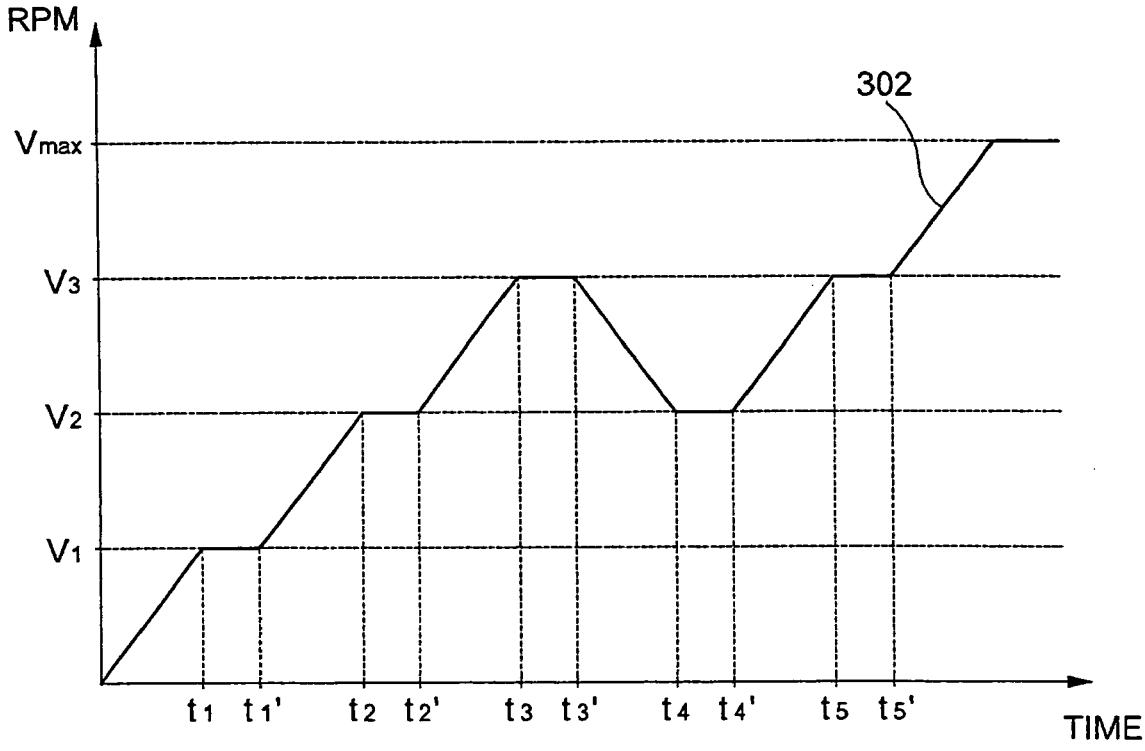
FIG. 3 is a graph showing control characteristics of rotational speeds of a rotary tub according to vibration levels of the washing machine of FIG. 1.

FIG. 3 is a graph showing control characteristics of rotational speeds of the rotary tub 106 according to the vibration levels of the washing machine of FIG. 1. As shown in FIG. 3, to obtain a sufficient spin-drying effect, the rotational speed of the rotary tub 106 needs to ultimately reach a maximum rotational speed Vmax of the rotary tub 106. However, to allow the rotational speed of the rotary tub 106 to instantaneously reach the maximum rotational speed Vmax from a stopped state is not possible. The control unit 202 controls the motor driving unit 206 so that the rotational speed of the rotary tub 106 gradually reaches the maximum rotational speed Vmax within a certain period. In this case, from a viewpoint of a low vibration, a variation of the rotational speed of the rotary tub 106 may be a very important variable. A sudden increase of the rotational speed of the rotary tub 106 may result in high vibration so that attenuating by the vibration of the rotary tub 106 by suitably controlling the variation of the rotational speed of the rotary tub 106 according to the vibration level of the rotary tub 106 while increasing the rotational speed may be needed.

FIG. 3 illustrates a characteristic curve 302 representing the rotational speed variation of the rotary tub 106 in the washing machine of FIG. 1. On the characteristic curve 302, estimation intervals, such as intervals t1-t1', t2-t2', t3-t3', t4-t4' and t5-t5' are formed. The estimation intervals t1-t1', t2-t2', t3-t3', t4-t4' and t5-t5' represent periods in which the rotational speed of the rotary tub 106 is uniformly maintained and the control unit 202 estimates the vibration level. For example, the rotational speed of the rotary tub 106 is fixed during the first estimation interval t1-t1', so that the vibration level of the rotary tub 106 may be determined by detecting the variation of the drive power supplied to the motor 108 during the first estimation interval t1-t1'. The estimation is periodically performed until the rotational speed of the rotary tub 106 reaches the maximum rotational speed Vmax of the rotary tub 106. The rotational speed of the rotary tub 106 continuously increases from V1 to V3 while the detection of the vibration is performed during the second and third estimation intervals t1-t1' and t2-t2'. However, the rotational speed decreases again to V2 after the third estimation interval t3-t3'. The third estimation interval t3-t3' represents a region in which excessively high vibration occurs due to an excessively high rotational speed of the rotary tub 106. Therefore, after the third estimation interval t3-t3', the rotational speed of the rotary tub 106 decreases to V2, which is a previous level, thus resulting in the attenuation of the vibration. The vibration level of the rotary tub 106 is estimated again during the fourth estimation interval t4-t4' so that, if the vibration level of the rotary tub 106 is within a stable range, the rotational speed of the rotary tub 106 increases up to the maximum rotational speed Vmax of the rotary tub 106, which is a target rotational speed. During each of the first through fifth estimation intervals t1-t1', t2-t2', t3-t3', t4-t4' and t5-t5', the control unit 202 detects values of the drive power at positions of tn and tn', respectively, and determines the vibration level of the rotary tub 106 using a difference between the drive power values. That is, if the difference is large (i.e., greater than or equal to a reference value), the vibration is determined to be large in proportion to the difference, while if the difference is small (i.e., less than the reference value), the vibration is determined to be small in proportion to the difference.

The control unit 202 detects the vibration level of the rotary tub 106 during the rotation of the rotary tub 106 through the variation of the drive power supplied to the motor 108 when the motor 108 rotates. Further, the control unit 202 controls the rotational speed of the motor 108 to be increased, maintained or decreased according to the vibration level of the rotary tub 106 detected by the vibration detecting unit 206, thus resulting in the attenuation of the vibration of the rotary tub 106.

Figure 4:
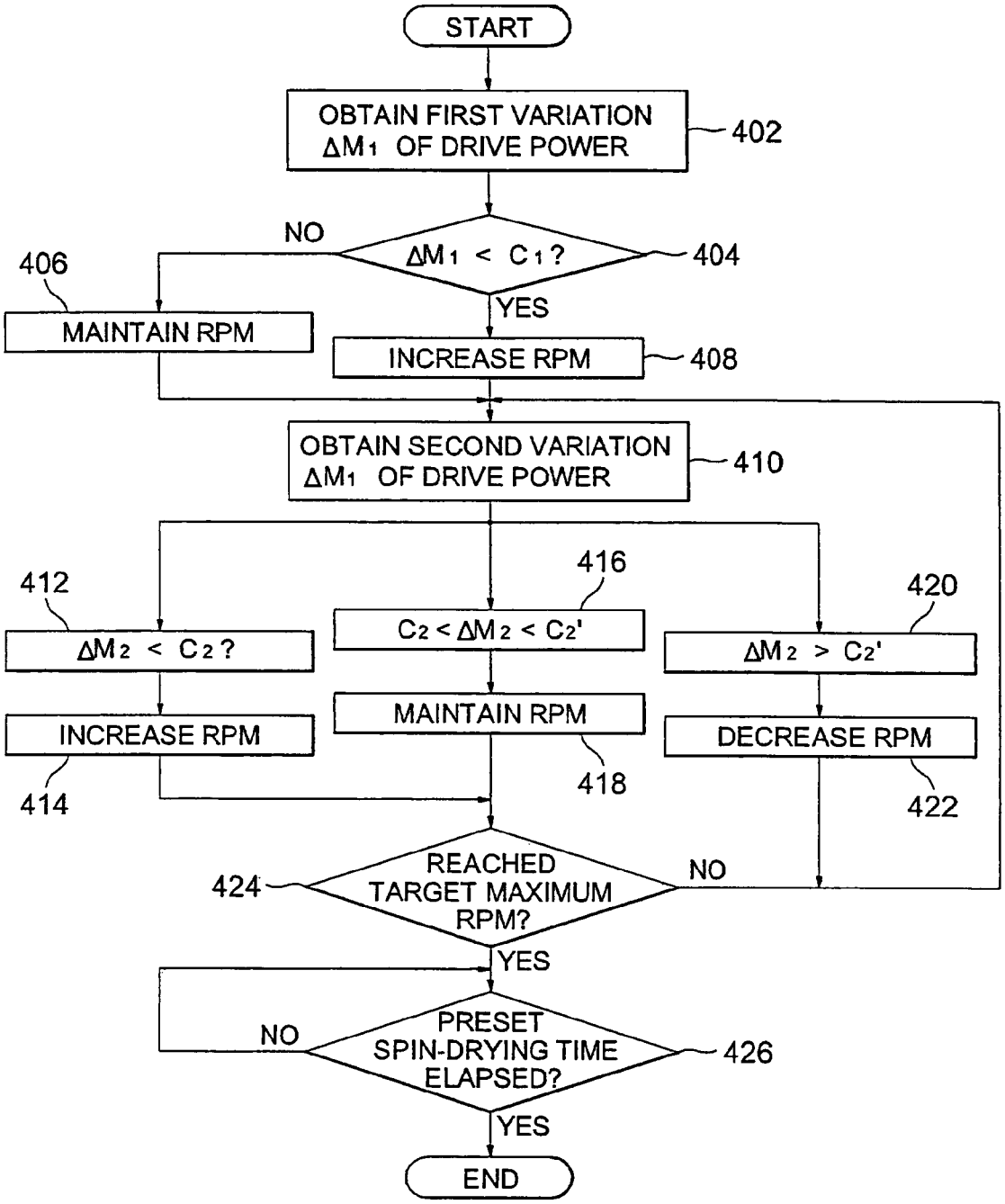
FIG. 4 is a flowchart of a method of controlling the washing machine of FIG. 1, according to the embodiment of the present invention.

FIG. 4 is a flowchart of a method of controlling the washing machine, according to the embodiment of the present invention. As shown in FIG. 4, the control unit 202 obtains a first variation ΔM1 of the drive power in operation 402. The first variation ΔM1 corresponds to the variation of the drive power detected during the first estimation interval t1-t1' of FIG. 3. The control unit 202 compares the first variation ΔM1 with a preset first reference value C1, and then determines whether to maintain or increase a current rotational speed of the rotary tub 106 in operation 404. If the first variation ΔM1 is not less than the preset first reference value C1, the control unit 202 determines that a vibration of the rotary tub 106 occurs and a vibration level thereof deviates from a stable range, and then maintains the current rotational speed of the rotary tub 106 (i.e., the RPM of the motor 108) without a change in operation 406. The preset first reference value C1 is obtained through experiments in a product development process, and is set to a value, which is a basis to determine whether the vibration level of the rotary tub 106 is within a stable range or deviates from the stable range at an initial time. If the first variation ΔM1 is greater than the preset first reference value C1, the control unit 202 determines that vibration did not occur or that the vibration level is within the stable range even though the vibration occurs, and then increases the current rotational speed of the rotary tub 106 (i.e., the RPM of the motor 108) in operation 408.

During a second estimation interval t2-t2' of the preset estimation intervals t1-t1', t2-t2', t3-t3', t4-t4' and t5-t5' for the vibration levels, the control unit 202 obtains a second variation ΔM2 of the drive power in operation 410. During the second estimation interval t2-t2', the control unit 202 compares the second variation ΔM2 with two second reference values C2 and C2'. If the second variation ΔM2 is less than the second reference value C2, the control unit 202 determines that the vibration level of the rotary tub 106 is within the stable range in operation 412, and increases the current rotational speed of the rotary tub 106 (i.e., the RPM of the motor 108) in operation 414. If the second variation ΔM2 is greater than the second reference value C2 and is less than another second reference value C2', the control unit 202 determines that the vibration level of the rotary tub 106 is not within the stable range but the vibration level is not excessively high in operation 416, and maintains the current rotational speed of the rotary tub 106 without a change thereto in operation 418. If the second variation ΔM2 is greater than the second reference value C2', the control unit 202 determines that the vibration level of the rotary tub 106 deviates from the stable range and is in an unstable state in operation 420, and decreases the current rotational speed of the rotary tub 106 (i.e., the RPM of the motor 108) in operation 422, thus resulting in an attenuation of the vibration together with the current rotational speed of the rotary tub 106.

The above control operations of increasing, maintaining or decreasing the current rotational speed of the rotary tub 106 are repeatedly performed so that the current rotational speed increases to the maximum rotational speed of the rotary tub 106, which is the target rotational speed, in operation 424. A spin-drying process is executed while the rotary tub 106 rotates at the maximum rotational speed, and the spin-drying process terminates after a preset spin-drying time has elapsed in operation 426.

As is apparent from the above description, the present invention provides a washing machine and method of controlling the washing machine, which results in an attenuation of a vibration of a rotary tub by suitably controlling a rotational speed of the rotary tub (or RPM of a motor) according to a vibration level of the rotary tub during a rotation of the rotary tub, thus stable operations are performed in all processes related to the rotation of the rotary tub.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A washing machine, comprising:

a rotary tub;

a motor linked to the rotary tub to be supplied with drive power and rotating to rotate the rotary tub;

a vibration detector to detect a vibration level of the rotary tub during a rotation of the rotary tub using a variation of the drive power supplied to the motor when the motor rotates; and a controller to control a current rotational speed of the motor to be increased, maintained or decreased according to the vibration level of the rotary tub detected by the vibration detector, to attenuate the vibration level of the rotary tub, wherein the variation of the drive power supplied to the motor corresponds to a plurality of different reference ranges which determine the vibration level of the rotary tub, and wherein the plurality of different reference ranges include:

a first reference range representing when a rotating state of the rotary tub is stable;

a second reference range representing when the rotating state of the rotary tub is desirable; and a third reference range representing when the rotating state of the rotary tub is unstable.

2. The washing machine according to claim 1, wherein the controller controls an intensity of the drive power to allow the current rotational speed of the motor to follow a target rotational speed of the motor.

3. The washing machine according to claim 1, wherein the vibration detector detects a voltage and a phase of the drive power.

4. The washing machine according to claim 1, wherein the controller obtains detection results for the vibration level by the vibration detector at regular preset intervals, and determines the vibration level of the rotary tub based on a difference between two neighboring detection results which indicates whether the difference between two neighboring detection results is within one of the plurality of different reference ranges.

5. The washing machine according to claim 4, wherein the controller varies the current rotational speed of the motor by stages according to the vibration level of the rotary tub so that the vibration attenuates.

6. A method of controlling a washing machine, the washing machine having a rotary tub and a motor linked to the rotary tub to be supplied with drive power and rotating to rotate the rotary tub, the method comprising:

detecting a vibration level of the rotary tub during a rotation of the rotary tub using a variation of the drive power supplied to the motor when the motor rotates; and controlling a current rotational speed of the motor to be increased, maintained or decreased according to the detected vibration level of the rotary tub to attenuate the vibration of the rotary tub, wherein the detecting of the vibration level comprises:

defining a plurality of different reference ranges for a variation of the drive power so as to determine the vibration level of the rotary tub; and ascertaining to which of the plurality of different reference ranges the variation of the drive power belongs to determine the vibration level of the rotary tub, and wherein the plurality of different reference ranges include:

a first reference range representing when a rotating state of the rotary tub is stable;

a second reference range representing when the rotating state of the rotary tub is desirable; and a third reference range representing when the rotating state of the rotary tub is unstable.

7. The method according to claim 6, wherein the controlling of the current rotational speed comprises:

controlling an intensity of the drive power to allow the current rotational speed of the motor to follow a target rotational speed of the motor.

8. The method according to claim 6, further comprising:

increasing the current rotational speed of the motor when the rotating state of the rotary tub is determined to be stable based on detection results for the vibration level.

9. The method according to claim 6, further comprising:

maintaining the current rotational speed of the motor without a change thereof when a rotating state of the rotary tub is determined to be desirable based on detection results for the vibration level.

10. The method according to claim 6, further comprising:

decreasing the current rotational speed of the motor when a rotating state of the rotary tub is determined to be unstable based on detection results for the vibration level.

11. The method according to claim 6, wherein the detecting of the vibration level is performed to obtain detection results for the vibration level at regular preset intervals, and the vibration level of the rotary tub is determined based on a difference between two neighboring detection results which indicates whether the difference between two neighboring detection results is within one of the plurality of different reference ranges.

12. The method according to claim 11, further comprising:

varying by stages the current rotational speed of the motor according to the vibration level of the rotary tub so that the vibration attenuates.

13. The method according to claim 12, further comprising:

decreasing the current rotational speed of the motor to a rotational speed of a previous stage, when the rotating state of the rotary tub is unstable.

14. A washing machine having a rotary tub and a motor to drive the rotary tub, comprising:

a vibration detector to detect a vibration level of the rotary tub while the rotary tub is driven by the motor, the vibration level being detected according to a degree of variation of drive power supplied to the motor, as the motor rotates; and a controller to control a variable driving speed of the motor according to the vibration level of the rotary tub detected by the vibration detector to attenuate the vibration level of the rotary tub, wherein the variation of the drive power supplied to the motor corresponds to a plurality of different reference ranges which determine the vibration level of the rotary tub, and wherein the plurality of different reference ranges include:

a first reference range representing when a rotating state of the rotary tub is stable;

a second reference range representing when the rotating state of the rotary tub is desirable; and a third reference range representing when the rotating state of the rotary tub is unstable corresponds to a plurality of different reference ranges which determine the vibration level of the rotary tub, and wherein the plurality of different reference ranges include:

a first reference range representing when a rotating state of the rotary tub is stable;

a second reference range representing when the rotating state of the rotary tub is desirable; and a third reference range representing when the rotating state of the rotary tub is unstable.

15. A washing machine having a rotary tub and a motor to drive the rotary tub, comprising:

a power variation detector to detect a degree of variation of drive power supplied to the motor, as the motor rotates; and a controller to control a driving speed of the motor according the degree of variation detected by the power variation detector to attenuate a vibration level of the rotary tub, wherein the variation of the drive power supplied to the motor corresponds to a plurality of different reference ranges which determine the vibration level of the rotary tub, and wherein the plurality of different reference ranges include:

a first reference range representing when a rotating state of the rotary tub is stable;

a second reference range representing when the rotating state of the rotary tub is desirable; and a third reference range representing when the rotating state of the rotary tub is unstable.

16. The washing machine according to claim 15, wherein the controller controls an intensity of the drive power so that the driving speed of the motor follows a target speed of the motor.

17. The washing machine according to claim 15, wherein the controller determines the vibration level of the rotary tub based on a difference between respective pairs of detection results which indicates whether the difference between respective pairs of detection results is within one of the plurality of different reference ranges, wherein the difference between pairs of detection results is obtained from the power variation detector at regular intervals, and wherein the controller varies the driving speed of the motor by stages according to the determined vibration level.

18. A method of controlling a washing machine having a rotary tub and a motor to drive the rotary tub, comprising:

detecting a vibration level of the rotary tub while the rotary tub is driven by the motor, the vibration level being detected according to a degree of variation of drive power supplied to the motor, as the motor rotates; and controlling a driving speed of the motor according to the vibration level of the rotary tub to attenuate the vibration level of the rotary tub, wherein the variation of the drive power supplied to the motor corresponds to a plurality of different reference ranges which determine the vibration level of the rotary tub, and wherein the plurality of different reference ranges include:

a first reference range representing when a rotating state of the rotary tub is stable;

a second reference range representing when the rotating state of the rotary tub is desirable; and a third reference range representing when the rotating state of the rotary tub is unstable.

19. A method of controlling a washing machine having a rotary tub and a motor to drive the rotary tub, comprising:

detecting a degree of variation of drive power supplied to the motor, as the motor rotates;

controlling a driving speed of the motor according the degree of variation to attenuate a vibration level of the rotary tub, wherein the detecting of the vibration level comprises:

establishing a plurality of preset different reference ranges for the variation of the drive power, the established plurality of preset different reference ranges corresponding to vibration levels of the rotary tub; and comparing the degree of variation with the established plurality of different reference ranges to determine the vibration level of the rotary tub, and wherein the plurality of different reference ranges include first, second and third reference ranges, respectively, representing when a driving state of the rotary tub is stable, when the driving state of the rotary tub is desirable and when the driving state of the rotary tub is unstable, the controlling of the driving speed of the motor comprises:

increasing the driving speed of the motor when the driving state is determined to be stable;

maintaining the driving speed of the motor when the driving state is determined to be desirable; and decreasing the driving speed of the motor when the driving state is determined to be unstable.

20. The method according to claim 19, wherein the controlling of the driving speed comprises:

controlling an intensity of the drive power so that the driving speed of the motor follows a target speed of the motor.

21. The method according to claim 19, wherein the controlling of the driving speed comprises:

determining the vibration level of the rotary tub based on a difference between respective pairs of detection results obtained from the power variation detector at regular intervals; and varying the driving speed of the motor by stages according to the determined vibration level.

22. The method according to claim 19 wherein the increasing, maintaining or decreasing of the driving speed of the motor are repeatedly performed so that the driving speed increases to the maximum driving speed of the motor to drive the rotary tub; the control method further comprising:

performing a spin-drying process while the rotary tub rotates at the maximum driving speed; and terminating the spin-drying process after a preset spin-drying time has elapsed.

23. The method according to claim 21, wherein the controlling of the driving speed of the motor further comprises:

varying by stages the driving speed of the motor according to the vibration level of the rotary tub so that the vibration attenuates; and decreasing the driving speed of the motor to a driving speed of a previous stage, when the rotating state of the rotary tub is unstable.

* * * * *

UNITED STATES PATENT AND TRADEMARK OFFICE

CERTIFICATE OF CORRECTION

PATENT NO. : 7,340,791 B2
APPLICATION NO. : 10/902812
DATED : March 11, 2008
INVENTOR(S) : Ji Deok Jeong et al.

It is certified that error appears in the above-identified patent and that said Letters Patent is hereby corrected as shown below:

On the Title Page, Item (57) (Abstract), Line 10, change “motorrotates.” to --motor rotates.--.

Column 9, Line 12, after “Claim 19” insert --,--.

Signed and Sealed this

Twenty-ninth Day of July, 2008

JON W. DUDAS
*Director of the United States Patent and Trademark Office*